United States Patent [19]

Abbott

[11] 4,091,581

[45] May 30, 1978

[54] ACCOMMODATION FOR TEMPORARY MANNING OF VESSELS

[76] Inventor: Dennis Roland Abbott, 'Friarywood', Frome Rd., Hinton Charterhouse, Nr. Bath, County of Avon, England

[21] Appl. No.: 724,226

[22] Filed: Sep. 17, 1976

[30] Foreign Application Priority Data

Sep. 22, 1975 United Kingdom ..... 38871/75

[51] Int. Cl.[2] ..... E04B 1/348

[52] U.S. Cl. ..... 52/79.1; 52/143; 114/270; 114/71; 296/23 MC

[58] Field of Search ..... 52/79.1, 143, 79,2, 52/79.4; 9/1.2; 296/23 MC; 114/270 V, 71 X, 77; 209/115

[56] References Cited

U.S. PATENT DOCUMENTS

| | | | |
|---|---|---|---|
| 3,118,187 | 1/1964 | Alimanestiano | 52/122 |
| 3,265,025 | 8/1966 | Haigh | 9/1.2 |
| 3,618,273 | 7/1969 | Crandall | 52/79.4 |
| 3,792,558 | 2/1974 | Berce | 52/79.2 |
| 3,828,379 | 8/1974 | Walston | 9/1.2 |
| 3,830,177 | 8/1974 | Nemec | 114/73 |
| 3,978,536 | 9/1976 | Howe | 9/1.2 |

FOREIGN PATENT DOCUMENTS

| | | | |
|---|---|---|---|
| 2,259,020 | 8/1975 | France | 206/511 |
| 2,136,630 | 2/1973 | Germany | 52/79.1 |
| 2,515,510 | 10/1975 | Germany | 114/77 R |

*Primary Examiner*—Ernest R. Purser
*Assistant Examiner*—Henry Raduazo
*Attorney, Agent, or Firm*—Lawrence E. Laubscher

[57] ABSTRACT

Temporary accommodation on a vessel is provided by a watertight accommodation module adapted for transportation on a container truck and for handling by container handling equipment, thereby rendering the module readily transferable from vessel to vessel. Mounting shoes, a framework support and locking pins are provided to facilitate secure mounting of the module on a vessel above the deck surface.

1 Claim, 5 Drawing Figures

1
22
23
24
25
26
27
28

ACCOMMODATION FOR TEMPORARY MANNING OF VESSELS

BACKGROUND OF THE INVENTION

This invention relates to the provision of accommodation for temporary manning of vessels, particularly though not exclusively vessels under tow.

It is normal practice to tow bulky offshore equipment to site on unmanned pontoon barges. Quite apart from avoiding the danger of having an uncontrolled vessel if the tow parts which might be carried into shipping lanes because of the sail effect of the equipment, which might be a jacket for a drilling rig, thus causing a hazard to shipping and endangering its own expensive load, it will be appreciated that it is desirable to man the vessel so that other events during the tow endangering either the equipment or other shipping can be dealt with.

SUMMARY OF THE INVENTION

It is an object of this invention to provide temporary manning accommodation for vessels, and whilst the invention is particularly applicable to unmanned pontoon barges carrying offshore equipment it is envisaged that it can be utilized in connection with other unmanned vessels for example dumb lighters or derelict ships under tow, or in connection with running vessels (i.e. vessels moving under their own power) to provide accommodation additional to that already provided.

The present invention provides an accommodation module for providing accommodation for temporary manning of a vessel, said module being adapted for transportation on a container truck and for handling by container handling equipment, and comprising a watertight accommodation unit and means enabling said unit to be secured to a vessel.

The invention also provides an accommodation module for providing accommodation on a vessel, comprising a watertight accommodation unit adapted for transportation on a container truck and for handling by container handling equipment, and means enabling said unit to be secured to a vessel, said means comprising mounting shoe means secured to and depending from a floor of the unit and a framework support adapted to be secured to a surface of the vessel and provided with slot or recess means for receiving the shoe means whereby to support the unit above the vessel surface.

The invention also includes a method of providing temporary accommodation on a vessel, comprising providing an accommodation module comprising a watertight accommodation unit having mounting shoe means secured to and depending from a floor thereof and a framework support provided with slot or recess means for receiving said shoe means, transporting said module to the vessel, securing the framework support on a surface of the vessel with the slot or recess means uppermost, and mounting said unit on said framework support, said mounting step including locating and securing said shoe means in said slot or recess means.

BRIEF DESCRIPTION OF THE DRAWINGS

The foregoing and other aspects and features of the present invention will become more apparent upon consideration of the following description of an embodiment of the invention, taken in conjunction with the accompanying drawings, wherein.

DESCRIPTION OF A PREFERRED EMBODIMENT OF THE INVENTION

Figure 1:
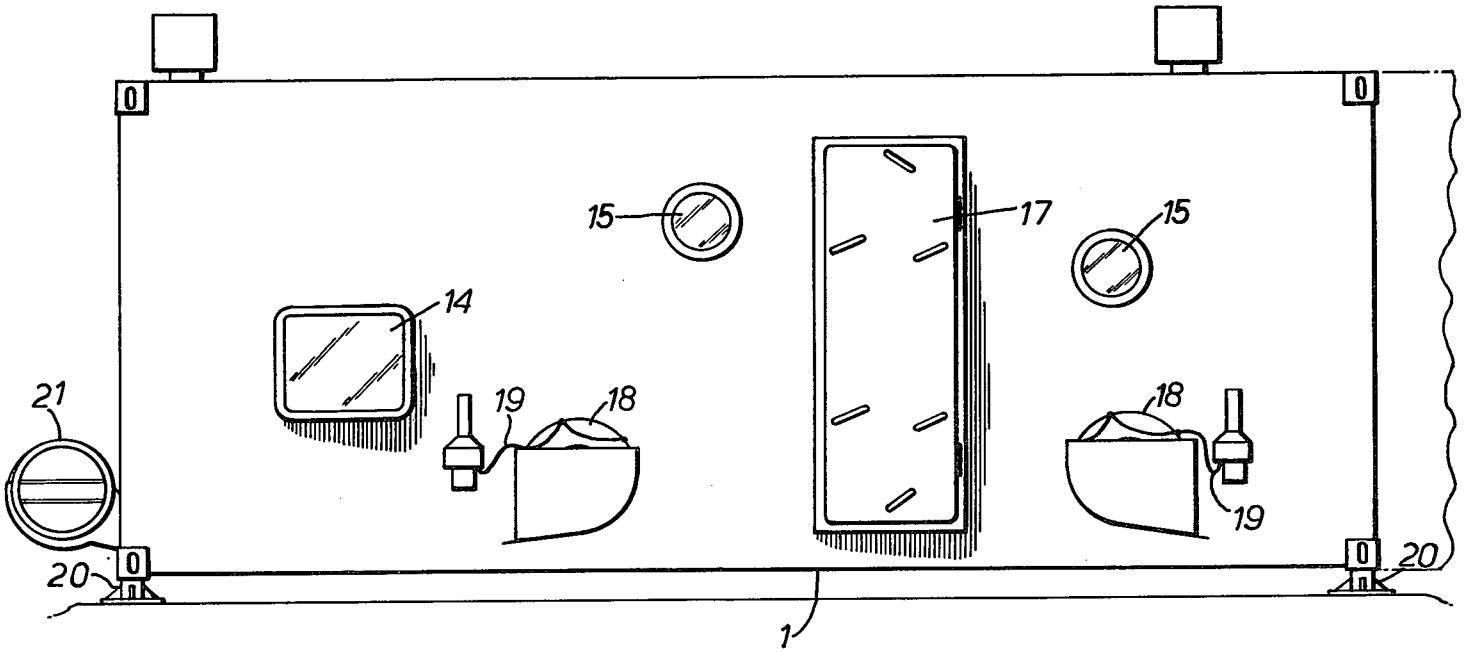
FIGS. 1 and 2 are respectively side and end views of an accommodation module.

The illustrated module comprises a watertight metal box-shaped accommodation unit 1 approximately 20 feet long by 8 feet high by 8 feet wide which unit is divided into two end sections 2 and 3 and an intermediate section 4 by internal bulkheads 5 having access apertures 6. In end section 2 there is provided two twin bunks 7 and four locker sets 8. A shower 9 and toilet 10 are located in the intermediate section 4, which has a drainage area 11, and the end section 3 which is a general messing and main room has a dining area 12 and cooking facilities 13.

The internal bulkheads and deckheads are lined with non-inflammable fire retardant insulating material of a high 'U' factor. The unit is completely watertight and a view of 360° from the module is provided by watertight windows 14 of armoured glass (one in each side and end of the unit) and watertight port holes 15 with armoured glass. A six dogged watertight access door 17 is provided in one side of the module.

Air ducting and electric fans provide ventilation when the unit is in its watertight condition, and internal and external lighting is preferably electrical. An electricity generating set (not shown) may be provided in the unit (for example in a partitioned off compartment in the end of section 3 or added thereto as an extension as shown in dotted line in FIG. 1) or separately therefrom, if desired.

Life saving equipment in the form of buoys 18, lines 19 and a four man inflatable life raft 21 are attached to the outside of the unit by mounting means on the module, and additional fitments may be provided on the exterior of the unit for securing temporary guide rails, man-overboard smoke and light markers and heaving lines.

Figure 2:
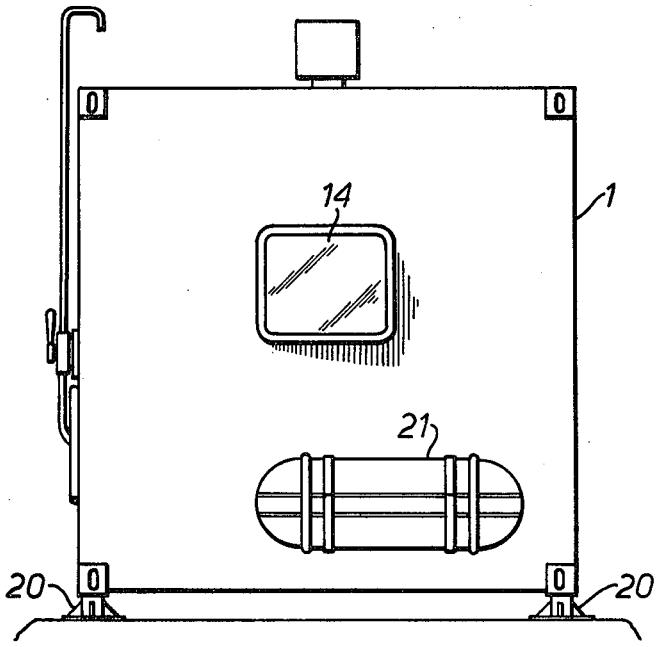
Figure 3:
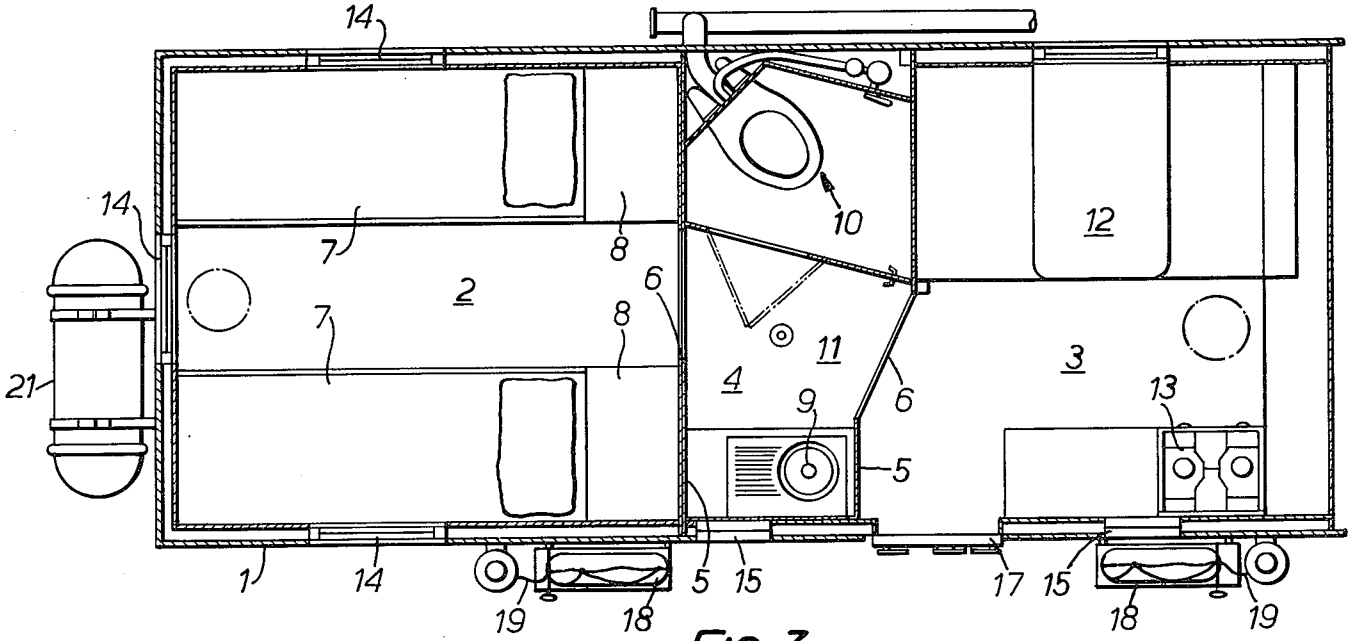
FIG. 3 is a fragmentary sectional plan view of the same module.
Figures 4, 5:
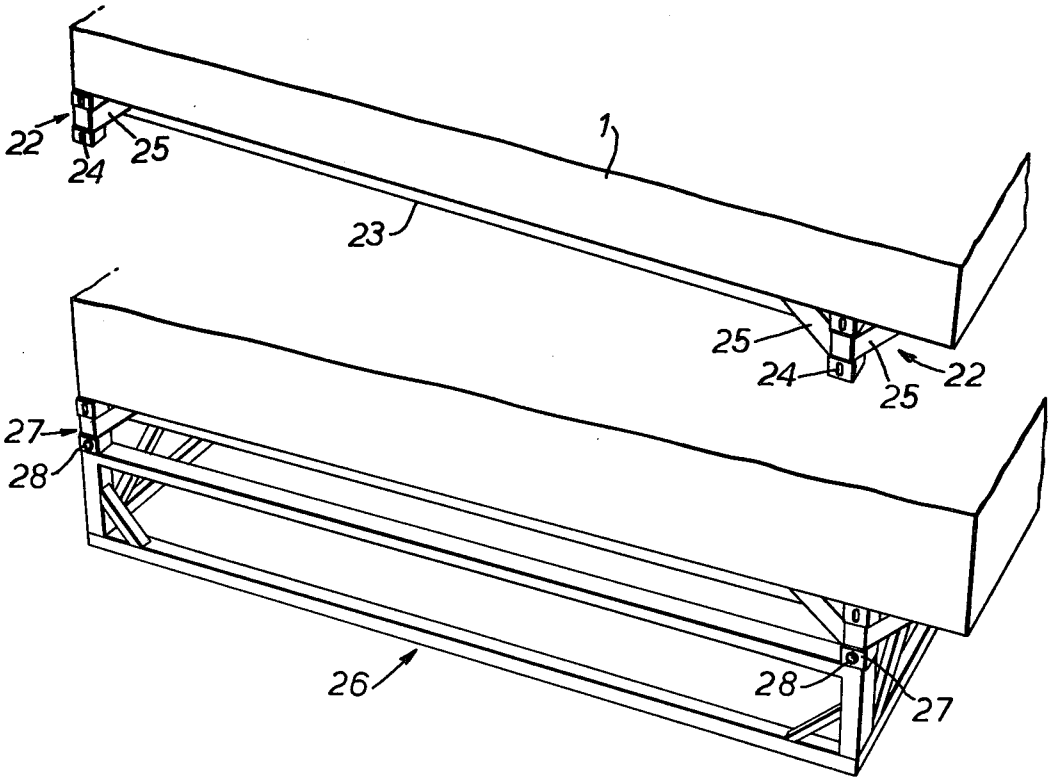
FIG. 4 is a fragmentary perspective view of a modified module provided with a preferred form of mounting means.
FIG. 5 is a fragmentary perspective view of the module of FIG. 4 shown mounted on a support framework thereof.

The module is provided with means by which it may be attached to the deck of a vessel. These means may comprise brackets 20 (FIGS. 1 and 2) by which the unit can be fixedly secured (for example by welding) directly to the deck. Alternatively, the brackets may be secured to a skid which itself is attached to the deck. FIGS. 4 and 5 show the preferred way in which this is achieved. The brackets are formed as shoe means 22 depending from the floor 23 of the module unit adjacent at least the corners of the unit. As illustrated, the unit is provided with four such shoe means (two only shown, a corresponding other two being provided on the other side of the unit), the left hand end shoe means being located at the very end of the unit and the other shoe means being spaced a little way inwardly of the right hand end of the units. The shoe means are formed of metal box sections and are provided with through holes 24. Diagonally extending strengthening members 25 extend between vertical members of the shoe means and the floor of the unit. These shoe means enable the unit to be supported above the deck surface on a skid comprising a metal framework support 26 which forms a generally rectangular box shaped structure of substantially the same plan dimensions as the unit and is provided with slot or recess means 27 extending uppermost for receiving the shoe means 22.

The framework support 26 is secured to the deck surface, for example, by welding and the unit is then mounted on the support 26, the shoe means 22 being located in the slot or recess means 27 as shown in FIG. 5. Thereafter, the shoe means are secured in the slot means, for example by pinning with locking pins 28 which extend through holes 24 in the shoe means and holes cooperable therewith in the framework support.

By supporting the unit above the deck surface it is advantageously not in direct contact with the sea when the deck is awash. Furthermore, the space defined within the framework structure provides useful storage facilities for life saving equipment etc. which may be stored therein instead of or as well as on the outside of the module.

The module is preferably supplied with additional equipment, which may or may not be stored in the module, including winches, pumps, a line and line throwing gun, fire fighting equipment and sea anchors.

It is to be understood that the module is designed to be transportable and to be handled by trucks and handling equipment designed for use with containers. As such the main external structure of the unit is based on a standard container and provided with conventional lifting points. Thus, after use on a vessel the module can be easily removed therefrom and moved either to store or to another vessel which requires temporary accommodation facilities.

The module thus provides watertight self-contained accommodation with ancilliary equipment which can be readily transferred from vessel to vessel as required to enable temporary manning of the vessel.

The advantages of manning vessels being towed are numerous, and include the possibility of regular inspection of the vessel and its cargo or load and in particular sea fastenings to see that unnecessary damage is not occurring due to wave action; ensuring that the vessel is correctly ballasted and complying with the International Rule of the Road for a vessel under tow; checking that the inboard end of the towing bridle is satisfactory and should chaffin occur, of taking corrective action; fire prevention should a fire hazard be or become apparent; dropping an anchor and/or sea anchor in the event of the tow parting or where the towing tug is unable to hold the tow due to adverse weather conditions; in cases where the tow has parted, the crew using emergency gear to quickly assist to reconnect by firing a line throwing gun or simply recovering and restreaming an emergency tow line where the towed vessel has run it down; and upholding the legal rights and the interest of the Owners and Charterers at all times throughout the period of tow.

At present it is envisaged that the crew will consist of three personnel, and that the person in charge would have sufficient knowledge equivalent to that of a person holding a Board of Trade third mate's certificate of the sea and its power and a sound knowledge of seamanship, barge operations, fire fighting and elementary first aid together with the ability to pass necessary signals to other shipping.

I claim:

1. In an accommodation module system adapted to provide accommodation for the temporary manning of a seagoing vessel, said module being adapted for transportation on a container truck and for mounting on the deck of a seagoing vessel, the improvement wherein (a) said accommodation module comprises a watertight metal box-shaped unit, said unit being divided by at least one internal bulkhead to form at least two compartments; and (b) means for securing said unit to the vessel, said means including (1) at least four mounting shoe means depending from the floor of said unit, each of said mounting shoe means being formed of a metal box section, one pair of said mounting shoe means being arranged adjacent two corners of said module and another pair of said mounting shoe means being spaced slightly inwardly from the other corners of said module;

(2) diagonally extending strengthening members extending from each of said shoe means to the floor of said unit, thereby to stabilize said shoe means;

(3) a metal framework support adapted to be fixedly secured to the deck of the vessel, said framework containing recess means for receiving said mounting shoe means, respectively;

(4) said framework support and said shoe means containing aligned through apertures; and (5) locking pin means extending through said aligned apertures for securing said unit to the framework support.

* * * * *